United States Patent [19]

Eisele et al.

[11] Patent Number: 5,000,151

[45] Date of Patent: Mar. 19, 1991

[54] METHOD FOR IMPROVING THE OPERATION OF A MOTOR VEHICLE DRIVEN WITH AN INTERNAL COMBUSTION ENGINE AND MOTOR VEHICLE WITH AN INTERNAL COMBUSTION ENGINE

[75] Inventors: Hermann Eisele, Vaihingen; Gergard Stumpp, Stuttgart; Wolf Wessel, Oberriexingen, all of Fed. Rep. of Germany

[73] Assignee: Robert Bosch GmbH, Stuttgart, Fed. Rep. of Germany

[21] Appl. No.: 23,946

[22] Filed: Sep. 22, 1986

Related U.S. Application Data

[63] Continuation of Ser. No. 740,140, Jun. 3, 1985, abandoned.

[30] Foreign Application Priority Data

Jul. 24, 1984 [DE] Fed. Rep. of Germany ..... 3427224

[51] Int. Cl.[5] ..... F02M 41/00; F02M 7/00

[52] U.S. Cl. ..... 123/503; 123/449; 123/436; 123/387

[58] Field of Search ..... 123/459, 478, 569, 436, 123/503, 449

[56] References Cited

U.S. PATENT DOCUMENTS

| | | | |
|---|---|---|---|
| T960,002 | 7/1977 | Moon | 123/436 |
| 4,228,773 | 10/1980 | Stumpp | 123/459 |
| 4,345,559 | 8/1982 | Kuttner | 123/436 |
| 4,357,662 | 11/1982 | Shira | 123/436 |
| 4,373,496 | 2/1983 | Greiner | 123/569 |
| 4,509,477 | 4/1985 | Takao | 123/436 |
| 4,513,721 | 4/1985 | Ina | 123/478 |

*Primary Examiner*—Carl Stuart Miller

*Attorney, Agent, or Firm*—Edwin E. Greigg

[57] ABSTRACT

A method is proposed for improving the operating behavior of motor vehicles driven by an internal combustion engine and especially to reduce jerking or bucking. The jerking, caused by rapid changes in engine torque, is damped by adapting the torque of the engine to the increase in output of the drive train of the vehicle. To this end, the deflection of the engine relative to the motor body is detected and used for vaying the fuel quantity metered to the engine. A differentiating member interposed between the engine and the body acts upon the fuel quantity adjusting device of the fuel metering device.

8 Claims, 2 Drawing Sheets

METHOD FOR IMPROVING THE OPERATION OF A MOTOR VEHICLE DRIVEN WITH AN INTERNAL COMBUSTION ENGINE AND MOTOR VEHICLE WITH AN INTERNAL COMBUSTION ENGINE

This is a continuation of copending application Ser. No. 750,140 filed June 3, 1985, now abandoned.

BACKGROUND OF THE INVENTION

The invention is based on a method for improving motor vehicle operation, and in particular to reduce jerking or bucking, as generally defined hereinafter. It has been found that when the gas pedal is actuated quickly by an operator of a vehicle, whether for acceleration or deceleration, many motor vehicles begin to jerk or buck. This unpleasant and in fact dangerous vehicle behavior can be traced to the drive train of the vehicle, which comprises gears, shafts and wheels and alternatively receives and imparts energy, somewhat like a spring, when the torque of the engine is changed. This alternation is all the more pronounced, the more quickly the engine torque changes. Accordingly, the object is to so control vehicle bucking as to dampen the vibration of the vehicle drive train during changes in torque.

OBJECT AND SUMMARY OF THE INVENTION

The method according to the invention has the advantage that the motor vehicle is gently accelerated decelerated, even when there is an abrupt movement of the gas pedal in either direction, by countercoupling the relative movement of the internal combustion engine and the quantity of fuel delivered to the engine. As a result, an excessive storage of energy in the drive train is avoided.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
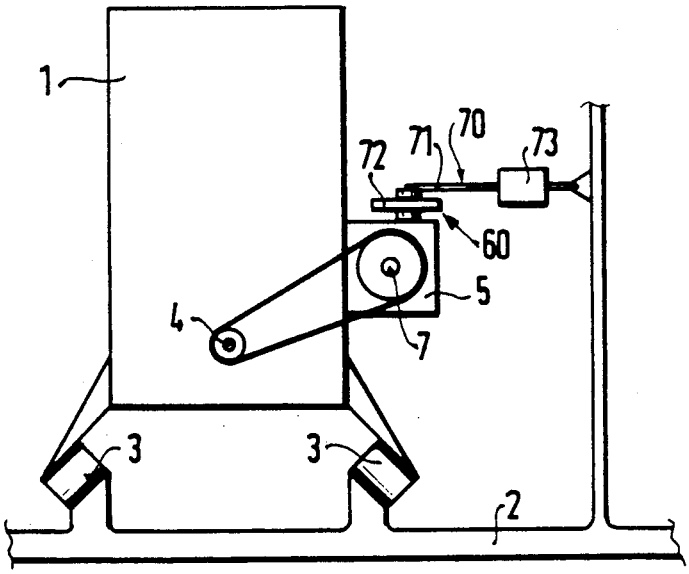
FIG. 1 shows an internal combustion engine having an injection pump and disposed in a vehicle body, seen in a simplified front elevational view.

An internal combustion engine 1 is supported or suspended upright on resilient shock absorbers 3 in the body 2 of a motor vehicle so that the engine 1 can pivot within predetermined limits, in particular about its axis of rotation 4, when rapid changes in load or torque occur. The engine 1 is supplied with fuel by an injection pump 5 secured on it and driven by it. A fuel injection pump of this kind is known and is described for instance in German Patent 21 58 689.

A pump drive shaft 7 is supported in the housing 6 of the injection pump 5 for a multi-cylinder internal combustion engine. The pump drive shaft 7 is coupled with a face cam disk 8 which has as many cams 9 as the engine has cylinders. The track of the cam disk 8 rests on rollers, not shown, which are supported in a ring 10 that is inserted into the pump housing 6 and is rotatable about the axis of the drive shaft 7 in order to adjust the instant of injection by means of a pin 11 which engages the ring 10. A pumping and distributing member 12 is coupled in drive terms with the face cam disk 8. Under the influence of springs 14, which are supported on one end on a pump body 15 closing off the pump housing 6 and on the other end on a yoke 13 surrounding the pumping and distributing member 12 and sliding axially on the face cam disk 8, the face cam disk 8 is pressed against the above-mentioned rollers of the ring 10.

The pumping and distributing member 12 slides in a cylinder liner 17, which is seated firmly in the pump body 15. The pump body 15 is closed off at the top by a screw cap 19, which presses a valve seat body 20 against the end face of the cylinder liner 17. A valve member 21 slides in the valve seat body 20 and in its closing position is pressed by a spring 22 against the valve seat body.

Disposed on the drive shaft 7 is a rotating displacement pump, which acts as a fuel delivery pump 25 and pumps fuel directly into the interior 26 of the housing 6. Branching off from the interior 26 is a conduit 27, which leads to an inlet conduit 28 in the cylinder liner 17. This conduit 28 cooperates with longitudinal grooves 29 in the end portion of the pumping and distributing member 12. These grooves discharge into the pump work chamber 30, which is adjoined also by the pressure valve 21. From the interior of the screw cap 19 located downstream of the valve 21, a conduit 31 located in the valve seat body 20 and in the wall of the cylinder liner 17 branches off and discharges into a radial conduit 32. This conduit 32 cooperates with an annular conduit 33 in the pumping and distributing member 12. Branching off from the annular conduit 33 is a distributor groove 34 in the pumping and distributing member 12. The distributor groove 34 cooperates with outlet conduits 35, only one of which is shown. These outlet conduits 35 are located radially in the cylinder liner 17 and on an incline in the pump body 15; they discharge into outlet connection openings 36, which serve to connect the injection lines, not shown, to the injection nozzles of the engine 1, which are also not shown. As with the cams 9 of the face cam disk 8, there are as many longitudinal grooves 29 and outlet conduits 35 having the connection openings 36 as there are cylinders of the engine 1.

From the pump work chamber 30, an axial conduit 38 leads in the pumping and distributing member 12 to a transverse conduit 39. The mouths of this transverse conduit 39 in the jacket face of the pumping and distributing member 12 cooperate with a control slide 41, which is axially displaceable on the pumping and distributing member 12. To this end, a ball-like arm 42 of a two-armed lever 43 supported or a ball pin 44 engages a recess of the control slide 41. This ball pin 44 is seated eccentrically on the end face of a shaft 45 supported in the pump housing 6 and serves to adjust the full-load fuel quantity and to shut off the fuel quantity. The other arm 46 of the two-armed lever 43 is engaged by the ball-shaped end of a governor sleeve 47, which serves as the adjusting member of a speed governor and which is displaceable on a governor shaft 48 disposed firmly in the housing 6. A gear wheel 49 which is rotatable on the governor shaft 48 meshes with a gear wheel 50 disposed firmly on the pump drive shaft 7. Pockets 51 formed from sheet metal in which flyweights 52 are supported are firmly joined to the gear wheel 49. With arms 53, the flyweights 52 engage the governor sleeve 47.

Acting as governor springs upon the arm 46 of the two-armed lever 43 are a compression spring 54 and a tension spring 55. The compression spring 54 engages the lever arm 46 directly and is supported on a bolt 56. One end of the tension spring 55 is suspended on this bolt 56, and its other end engages an element 57 articulatedly joined to a lever 58. The lever 58 is seated on one end of a shaft 59 in the interior of the housing 6 and the shaft is rotatably supported in the housing 6. The other end of the shaft 59, which protrudes out of the housing 6, serves to connect an adjusting device 60 to be described below.

The pin 11 joined to the ring 10 extends with its end portion protruding from the housing 6, into the known timing device 66, which is rotatably disposed in a means comprising a piston 67 of a hydraulic adjusting unit. The piston 67 is acted upon on one end by the pressure in the interior 26 of the housing 6; a spring, not shown, presses against the other end of the piston. This end of the piston communicates with the intake side of the delivery pump 24. The fuel delivery pump 24 feeds fuel into the interior 26 of the housing 6 under rpm-dependent pressure, which is exerted upon the piston 67 of the hydraulic adjusting unit and thereby adjusts the ring 10, the rotational position of which determines the supply onset of the injection pump, in accordance with rpm.

With the engine 1 running, the drive shaft 7 of the injection pump 5 rotates, and accordingly so does the face cam disk 8, which in cooperation with the rollers of the ring 10 generates an axially reciprocating and simultaneously rotating movement of the pumping and distributing member 12. Upon each compression stroke of the pumping and distributing member 12, a quantity of fuel is pumped out of the pump work chamber 30 via the opened valve 21, through the conduits 31 and 32, into the annular conduit 33, and from there via the distributor groove 34 to one of the cutlet conduits 35 and through the associated connection opening 36 to one of the injection nozzles of the engine 1.

To adapt the rpm and torque of the engine to various operating states, such as idling, maximum rpm, partial load and full load, usually only a portion of the maximal fuel quantity aspirated by the pumping and distributor member 12 is delivered to a cylinder of the engine. The remainder of the fuel is diverted through the axial conduit 38 and the transverse conduit 39 during the compression stroke of the pumping and distributing member 12, by connecting the pump work chamber 30 with the interior 26 of the housing 6 in accordance with the position of the control slide 41. The position of the control slide 41 at any given time, which is the determining factor for the metering of the fuel quantity to be injected at that time, is determined by the lever 43; via the tension spring 55, the adjusting device 60 acting on the lever 43 from outside, for instance via the accelerator pedal, the governor spring 47 of the rpm governor, and the ball pin 44 all act upon the lever 43 for full load and shutoff.

In order to damp and overcome jerking or bucking of the motor vehicle and oscillations in the drive train of the vehicle, caused by rapid changes in the torque of the engine or drive train, and during which the engine 1 tilts to one side or the other, the torque produced by the engine is decreased or increased by supplying a reduced or increased amount of fuel. To this end, the deflection of the engine 1 with respect to the body 2 is detected by a differentiating member 70, and accordingly, the fuel supply quantity is adjusted by this member preferably with a certain time delay, by varying the position of the control slide 41 of the supply quantity adjusting device of the injection pump 5.

Figure 2:
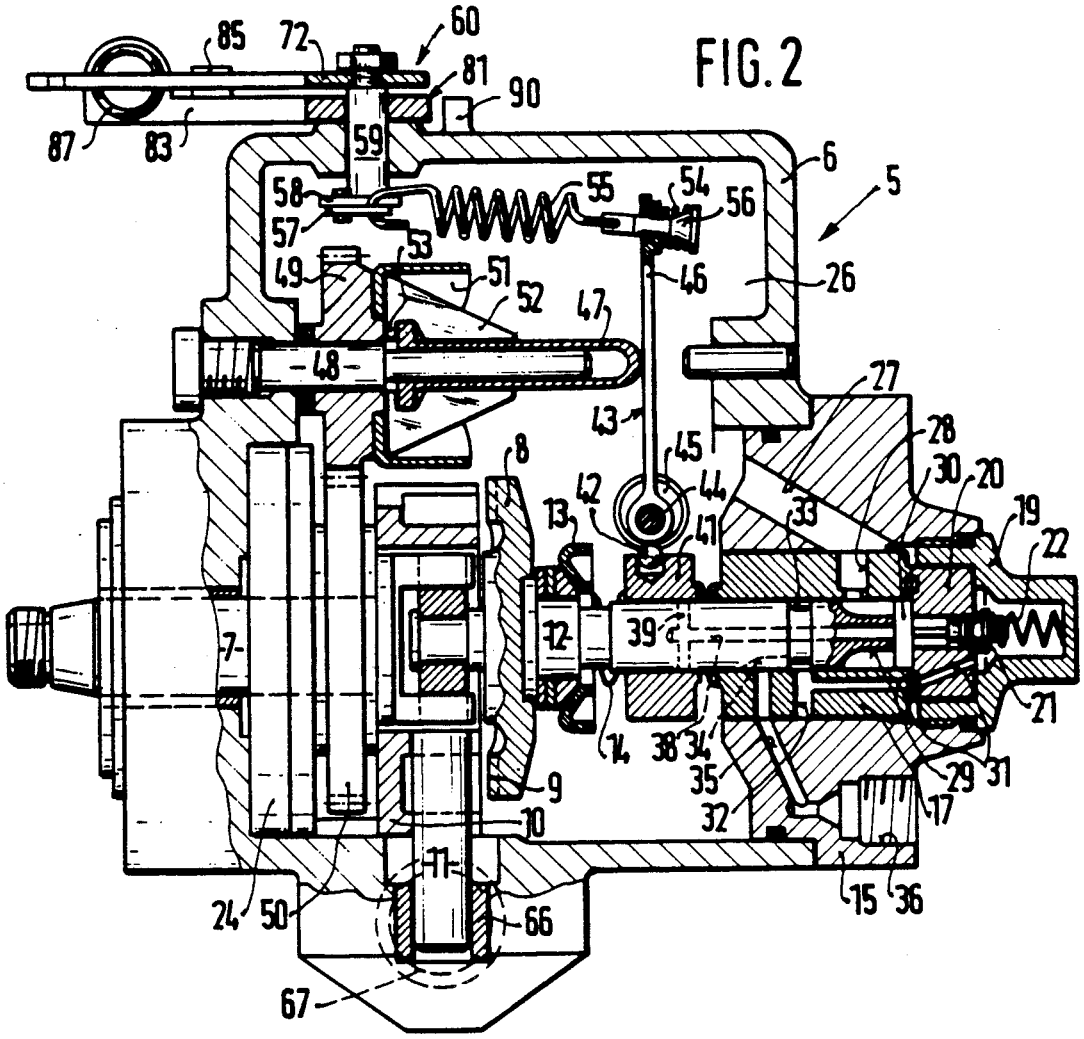
FIG. 2 is a longitudinal cross section taken through the injection pump of FIG. 1.
Figure 3:
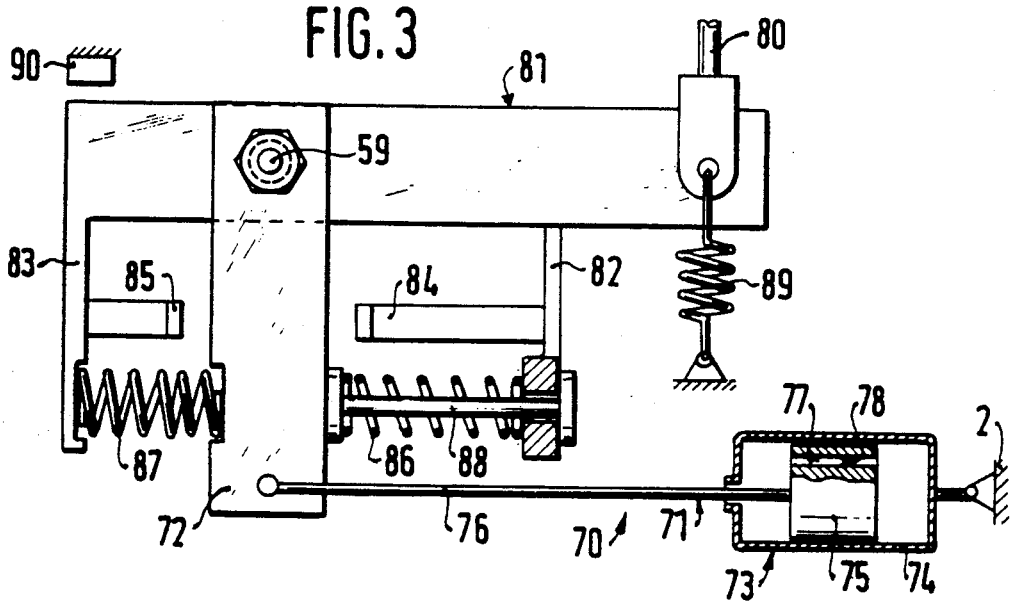
FIG. 3 is a detail view of a mechanical adjusting device for the injection pump of FIG. 2, seen in a plan view.

The relative movement or deflection of the engine with respect to the body 2 supporting it is detected, in the exemplary embodiment of FIGS. 1–3, by a mechanical linkage 71, which is articulated at one end on the body 2 and at the other on an adjusting lever 72, which is joined to the adjusting shaft 59 of the adjusting device 60 of the injection pump 5 and is oriented approximately parallel to the crankshaft axis 4 of the engine 1. In order to attain damping and a time delay for the fuel quantity adjustment, a hydraulic damper 73 is incorporated into the linkage 71, its housing 74 being joined to the body 2 and its piston 75 being joined to the rod 76 leading to the lever 72. A longitudinal bore 77 having a throttle 78 in the piston 75 joins the chambers on both sides of the piston 75. The adjusting direction of the adjusting lever 72 for varying the fuel quantity is selected such that the fuel quantity drops if, with increasing torque, the engine 1 tilts in its suspension and the adjusting lever 72 is supported via the damper 73 on the body 2.

The movement transmitted via a rod 80 for depressing and retracting the accelerator pedal, not shown, is transmitted via a double lever 81, which is articulated on the rod 80 and rotatably supported on the shaft 59, to the adjusting lever 72. For dragging the adjusting lever 72, the double lever 81 has two transversely offstanding arms 82, 83 having stops 84, 85 pointing toward the adjusting lever 72 and spaced apart therefrom on both sides. Also, compression springs 86, 87 are disposed between the adjusting lever 72 and the arms 82, 83, one of which, spring 86, is supported via a bolt 88 which is retained in the arm 82. The spring force of this spring 86 is dimensioned such that in the idling position of the adjusting lever 72, in which a tension spring 89 pulls the double lever 81 against a fixed stop 90 on the housing 6 of the injection pump 5, this spring 86 is in a state of equilibrium.

The variation of the fuel quantity metered to the engine 1 is effected as follows, in the exemplary embodiment of FIGS. 1–3:

When the accelerator pedal is actuated quickly with the rod 80 counter to the force of the spring 89 (acceleration), the adjusting lever 72 is carried along as well, via the spring 87. The adjusting lever 72 which is dragged along follows the double lever 81 only in a delayed manner, because it is supported on the body 2 via the linkage 71 and the damper 73. As the pedal is depressed further for acceleration, the stop 85 comes to rest on the adjusting lever 72 and moves with it. The accelerator pedal movement is thereby also delayed by means of the damper 73.

When the accelerator pedal is quickly retracted (deceleration), the spring 86 is compressed by the damper 73, again in a damped manner, until the adjusting lever 72 rests on the stop 84. Then the tension spring 86 pulls the double lever 81 and the adjusting lever 72, which is dragged along by the double lever 81 via the stop 84, counter to the action of the damper 73, in the direction intended for supplying a reduced fuel quantity. At the end of the movement, the spring 86 presses the adjusting lever 72 slowly away from the stop 84 into the middle position between the stops 84 and 85 as shown in FIG. 3. 15 With increasing torque, the engine 1, in its resilient suspension, tilts toward the right, toward the body 2 (FIG. 1). The adjusting lever 72 is then supported on the body 2 via the linkage 71 and the damper 73, and the adjusting lever 72 is pivoted in the direction toward reducing the quantity of fuel supplied. Conversely, when torque is rapidly decreasing, the engine 1 tilts toward the left (FIG. 1), whereupon the adjusting lever 72 is pivoted away from the linkage 71 and the damper 73 in the direction of an increased fuel quantity. The damper 73 here has a dual effect: first, a differentiating action in varying the fuel quantity caused by an engine deflection, and second, a delaying action when the accelerator pedal is depressed. With the countercoupling of the engine movement and the metered fuel quantity, jerking or bucking of the vehicle is actively damped.

Figure 4:
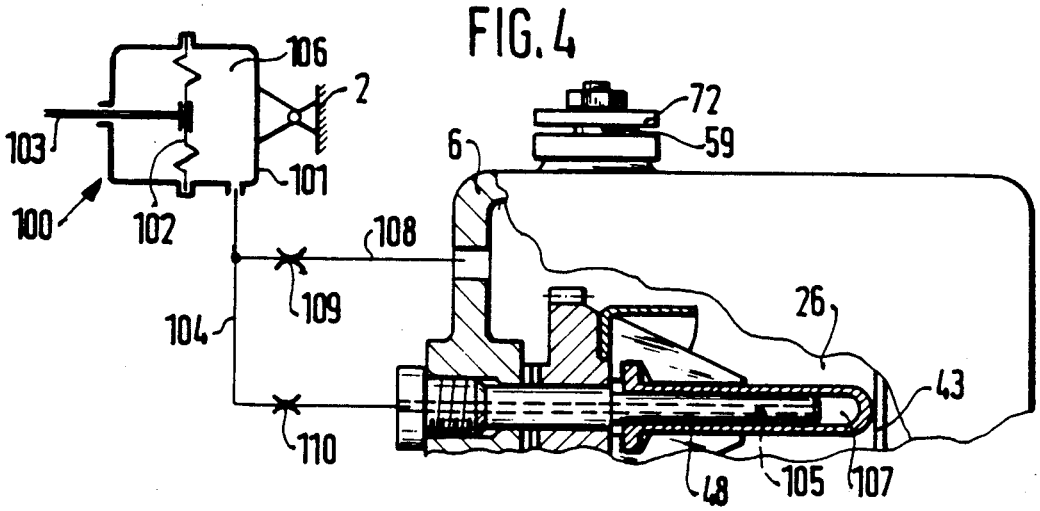
FIG. 4 is a fragmentary sectional view in simplified form of a hydraulic adjusting device for the injection pump according to FIG. 2.
Figure 5:
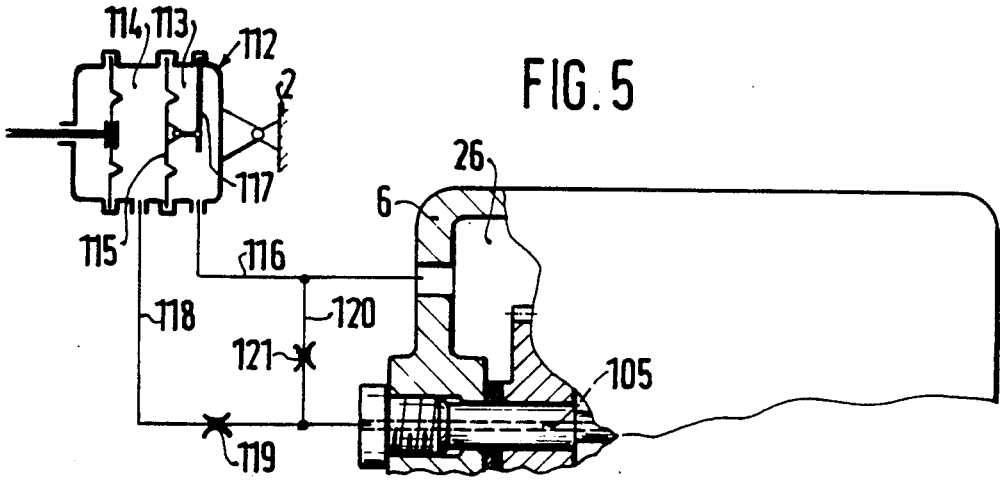
FIG. 5 is another fragmentary sectional view, in simplified form, of a second exemplary embodiment of a hydraulic adjusting device for the injection pump.

Deviating from the mechanically acting differentiating member for adjusting the fuel metering, the two exemplary embodiments of FIGS. 4 and 5 have a hydraulically acting differentiating member. Also, the adjustment of the fuel quantity originating at the differentiating member is performed not via the adjusting lever, which in this case is joined to the accelerator pedal, and the adjusting shaft 59, which are joined via the tension spring 55 to the lever 43, but rather via the governor sleeve 47 of the rpm governor. To this end, the governor sleeve 47 which engages lever 43 and its cooperating governor shaft 48, acts as a cylinder and piston, respectively.

To detect deflections of the engine 1 and to actuate the supply quantity adjusting device, a hydraulic adjusting cylinder 100 is provided, the housing 101 of which is secured in an articulated manner to the vehicle body 2 and the piston rod 103 of which, joined to a diaphragm 102, is secured in an articulated manner on the upper portion of the engine 1. A line 104 and an axial bore 105 in the governor shaft 48 join a chamber 106 of the adjusting cylinder 100 to the cylinder chamber 107 between the governor shaft 48 and the governor sleeve 47. A line 108 having a throttle 109 branches off from the line 104 and leads into the interior 26 of the pump housing 6. The chamber 106 of the adjusting cylinder 100, like the cylinder chamber 107 and the interior 26 of the pump housing 6, is filled with fuel, and in a state of equilibrium the same pressure prevails in it as in the interior of the housing 26.

Upon deflection of the engine 1 in the one direction fuel is positively displaced out of the chamber 106 of the adjusting cylinder 100, thereby increasing its pressure, and into the cylinder chamber 107 of the governor sleeve 47, causing the sleeve to be displaced on the governor shaft 48 toward the lever 43 and pivoting the lever 43 in the direction of a fuel quantity reduction. Since the fuel quantity positively displaced in the adjusting cylinder 100 is relatively large by comparison with the volume of the cylinder chamber 107 of the governor sleeve 47, an equalization takes place via the line 108 and the throttle 109. Conversely, the governor sleeve 47 is pulled away from the lever 43 in the direction of an increase in fuel quantity if, because of a deflection of the engine 1 in the other direction, fuel is aspirated into the chamber 106 of the adjusting cylinder 100. A delay when the metered fuel quantity is decreased or increased is attained by means of a throttle 110 in the line 104 leading to the cylinder chamber 107 in the governor sleeve 47.

In another exemplary embodiment (FIG. 5) having a hydraulically acting differentiating member, an adjusting cylinder 112, which is disposed like the adjusting cylinder 100 and is also similar in structure, additionally has a second fuel-filled chamber 113, which is separated from the work chamber 114 by a second diaphragm 115. This chamber 113 communicates via a line 116 with the interior 26 of the pump housing 6 and contains a leaf spring 117 connected to the diaphragm 115. The work chamber 114 communicates via a line 118 and a throttle 119 with the cylinder chamber 107 of the governor sleeve 47. Furthermore, a line 120 having a throttle 121 joins the two lines 116 and 118.

This embodiment functions similarly to the above-described embodiment of FIG. 5. Because of the additional chamber 113 and the spring 117, it has the further advantage that it is capable of yielding more upon a deflection of the engine 1 and accordingly has a longer effective life.

Varying the fuel quantity metered to an engine in order to vary its torque upon bucking of the motor vehicle and oscillation in its drive train is described in the above exemplary embodiments in connection with a piston injection pump of the distributor type. The invention can also, however, be applied in other fuel metering apparatuses in order to actuate their fuel quantity adjusting device in the same direction.

The foregoing relates to preferred exemplary embodiments of the invention, it being understood that other variants and embodiments thereof are possible within the spirit and scope of the invention, the latter being defined by the appended claims.

What is claimed and desired to be secured by letters patent of the United States is:

1. A method for improving the operating behavior of a motor vehicle driven by a self igniting internal combustion engine, mounted in a vehicle body upon resilient means and provided with a fuel injection pump having an arbitrarily adjustable fuel injection quantity adjusting member on said engine for setting a fuel metering device; comprising the steps of:

detecting short relative movements counter to said resilient means between said internal combustion engine and said vehicle body by means of one sensor arranged between said vehicle body and said fuel injection quantity adjusting member on said engine as a travel signal, differentiating said travel signal and forming thereby a correcting signal over the length of said travel signal, correcting by means of said correcting signal the setting of said fuel metering device in a negative feedback manner independently of the setting of said arbitrarily adjustable member thereby producing a negative torque of the engine against a torque producing the relative movement from which said correcting signal is derived.

2. A device for improving the operating behavior of a motor vehicle driven by an internal combustion engine resiliently mounted in a vehicle body with a fuel metering system arbitrarily controllable by a supply quantity adjusting device mounted on said internal combustion engine which comprises differentiating means disposed between and connected to said supply quantity adjusting device on the engine and said vehicle body to detect rapid relative movement of said internal combustion engine with respect to said motor vehicle body and said means directly corrects the magnitude of an arbitrary supply quantity to compensate for a torque which has produced said rapid relative movement of said internal combustion engine relative to said vehicle body.

3. A method as defined by claim 1 comprising the further steps of providing control means to vary fuel metering to said engine in accordance with deflection of said vehicle engine relative to said vehicle body.

4. A device as defined by claim 2, further wherein said differentiating means detects the magnitude of the movement of said internal combustion engine relative to said vehicle body.

5. A device as defined by claim 4, further wherein said differentiating means further includes a linkage and damper means which is interposed between and connected to said motor vehicle body and said quantity adjusting device.

6. A device as defined by claim 4, further wherein said differentiating means further includes a hydraulic means.

7. A device as defined by claim 6, further wherein said hydraulic linkage means includes an adjusting cylinder and pressure equalizing throttles.

8. A device as defined by claim 7, further wherein said adjusting cylinder further includes a pressure equalizing chamber.

* * * * *